United States Patent [19]

Hartman et al.

[11] Patent Number: 4,715,295

[45] Date of Patent: Dec. 29, 1987

[54] OVERBED TABLE

[75] Inventors: Daniel A. Hartman, Sunman; L. Dale Foster, Brookville, both of Ind.

[73] Assignee: Hill-Rom Company, Inc., Batesville, Ind.

[21] Appl. No.: 759,635

[22] Filed: Jul. 26, 1985

[51] Int. Cl.[4] ..... A47B 57/00

[52] U.S. Cl. ..... 108/93; 108/87

[58] Field of Search ..... 108/93, 73, 75, 63, 108/65, 87; 312/301, 308, 310, 311

[56] References Cited

U.S. PATENT DOCUMENTS

| | | | |
|---|---|---|---|
| 614,722 | 11/1898 | Isaacs | 108/93 X |
| 831,797 | 9/1906 | Miller | 108/93 |
| 1,063,642 | 6/1913 | Birdsall | 108/93 X |
| 1,472,570 | 10/1923 | Snider . | |
| 1,964,490 | 6/1934 | Walter | 108/87 |
| 2,105,868 | 1/1938 | Thomas | 108/93 |
| 2,696,246 | 12/1954 | Putnam | 108/93 |
| 2,848,290 | 8/1958 | Doty | 108/4 X |
| 3,089,743 | 5/1963 | Heyl | 312/227 |
| 3,406,933 | 10/1968 | Wait et al. | 108/93 X |
| 3,504,643 | 5/1970 | Burst et al. | 108/144 |
| 3,854,428 | 12/1974 | Fullenkamp | 108/146 |
| 4,077,333 | 3/1978 | Ballas | 108/6 |

FOREIGN PATENT DOCUMENTS

| | | | |
|---|---|---|---|
| 22066 | 3/1882 | Fed. Rep. of Germany | 108/63 |
| 923989 | 1/1955 | Fed. Rep. of Germany | 108/93 |
| 1243842 | 7/1967 | Fed. Rep. of Germany | 108/63 |
| 2646282 | 4/1978 | Fed. Rep. of Germany | 108/93 |
| 416759 | 9/1934 | United Kingdom | 108/75 |
| 439809 | 12/1935 | United Kingdom | 108/93 |
| 489491 | 7/1938 | United Kingdom | 108/63 |

*Primary Examiner*—Kenneth J. Dorner
*Assistant Examiner*—José V. Chen
*Attorney, Agent, or Firm*—Brian J. Leitten; F. Kristen Koepcke

[57] ABSTRACT

An improved table is disclosed which permits easy access to additional useable horizontal surface and which permits easy raising and lowering. The table, which in its preferred embodiment, is a hospital overbed table, is equipped with upper and lower horizontal tray surfaces. The surfaces are movable with respect to each other and may be positioned to expose the top surface alone or the upper and lower surfaces. The upper and lower surfaces may also be moved in unison to expose storage cavities in a base supporting the tray surfaces. A gas spring mechanism permits easy adjustment of the vertical positioning of the overbed table and provides a mechanism for securely locking the overbed table in place when in use.

4 Claims, 10 Drawing Figures

OVERBED TABLE

BACKGROUND AND OBJECTS OF THE INVENTION

The present invention relates to overbed tables for use by patients in hospitals and other health care facilities and, in particular, to an improved overbed table which provides functional versatilty previously unavailable in the health care field.

In hospital rooms and other patient room environments, it is desirable to provide a substantial amount of horizontal surface area for use as work surface for medical personnel and available surface for use by patients. Since the typical patient is confined to bed for substantial periods of time during a hospital stay, it has been found necessary to provide some means for bringing useable horizontal surfaces to the patient. This has resulted in a variety of overbed tables. A typical overbed table has a "C"-shaped configuration, the lower arm of the "C" comprising a wheeled base, the side or vertical section of the "C" comprising a support tube and a mechanism for raising and lowering the overbed table, and the upper horizontal section of the "C" comprising a generally flat horizontal surface. In its typical use, an overbed table is wheeled up to a patient bed. The base portion of the overbed table slides under the bed and the horizontal useable surface is adjusted at some position over the bed and accessable to the patient. The vertical section of the C-shaped overbed table approaches or abuts one side edge of the bed.

In the past, overbed tables have suffered from a number of disadvantages. Typically, the work or useable surface available to medical personnel and to patients is insufficient and becomes cluttered with food, medical supplies, flowers, cards and reading materials. When the overbed table is required to be used, e.g., for supporting a food tray, the items on the overbed table must be moved or rearranged. Typical prior art overbed tables are those described in U.S. Pat. Nos. 1,472,570, 2,848,290, 3,089,743, 3,504,643, 3,854,428 and 4,077,333.

Other attempts to develop improved overbed tables have resulted in impractical, complex and relatively expensive products which are awkward and difficult to use.

It is, therefore, an object of the present invention to avoid the problems associated with prior art attempts to develop overbed tables and to provide a simple and easy to use overbed table which is not subject to the problems described above.

Another object of the present invention is to provide an overbed table which provides sufficient horizontal surface for use by medical personnel or by patients without rearranging or relocating items already placed on the overbed table.

Another object of the present invention is to provide an overbed table which provides useable horizontal work surface for medical personnel without disturbing patient or personal belongings.

A further object of the present invention is to provide a vertical lift mechanism which permits easy adjustment of the vertical height of, e.g., an overbed table or other adjustable device.

SUMMARY OF INVENTION

These and other objects are achieved by the present invention, which is directed to an improved patient room overbed table which permits easy access to additional useable horizontal surface and which permits easy raising and lowering.

The overbed table of the present invention is equiped with an upper and lower horizontal tray surface. The surfaces are movable with respect to each other and may be positioned to expose the top surface alone or the upper and lower surfaces. The lower tray surface is movable with respect to the upper surface in either direction, which provides for additional flexibility and right and left handed use with respect to the patient bed.

A gas spring mechanism permits easy adjustment of the vertical positioning of the overbed table and provides a mechanism for securely locking the overbed table in place when in use and eliminating unexpected downward movement of the overbed table.

Substantial additional storage capacity is also provided by the improved overbed table of the present invention.

THE DRAWINGS

The objects and advantages of the present invention will become apparent from the following detailed description of the preferred embodiments thereof, in connection with the accompanying drawings in which like numerals designate like elements, and in which.

Figure 5A:
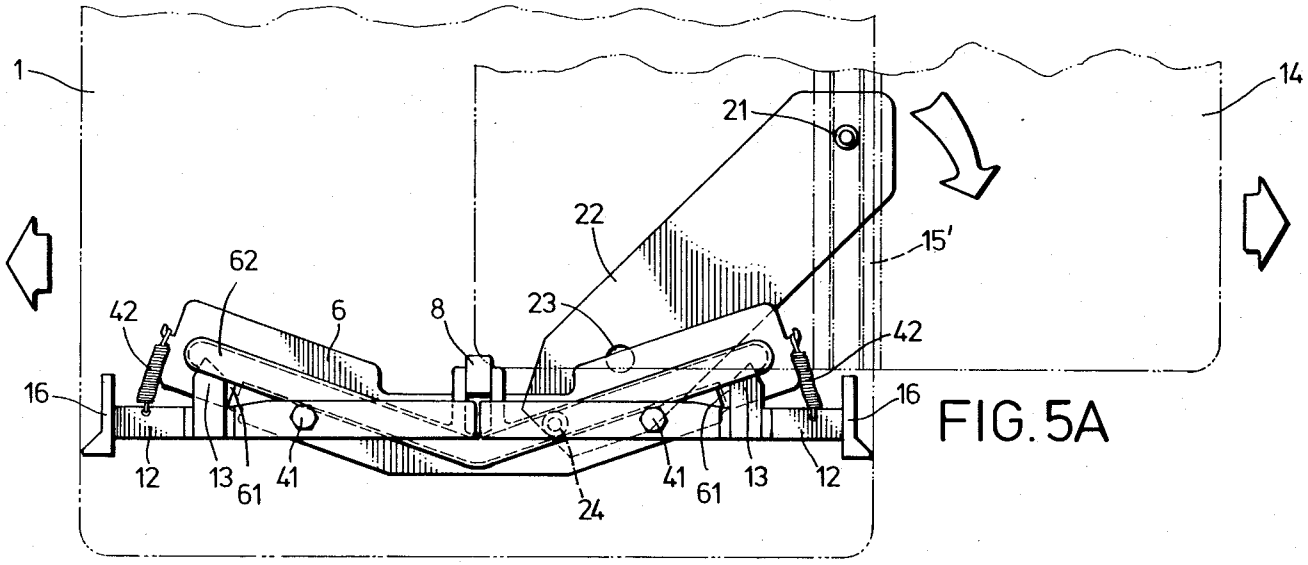
Figure 5B:
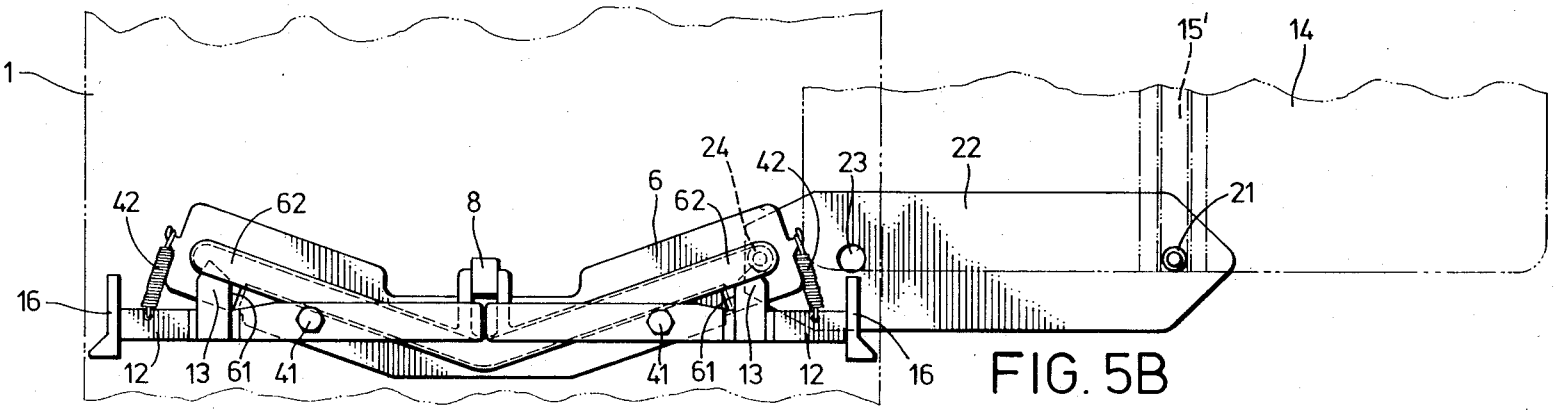
Figure 6:
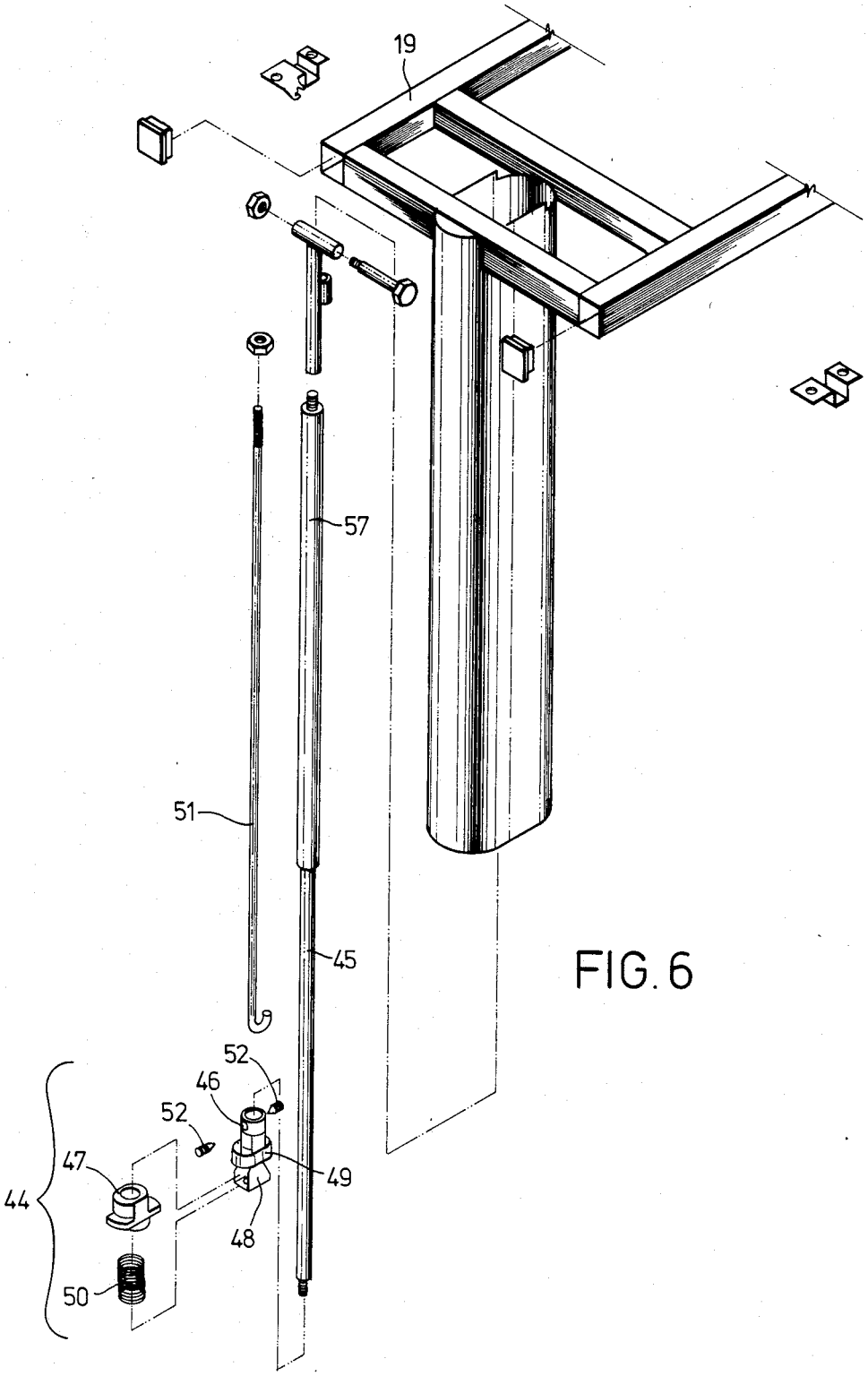

FIGS. 5A and 5B are top plan views showing the slide mechanism of the overbed table of the present invention in operation, FIG. 5A showing the slide mechanism in an intermediate position during the opening of the overbed table to expose the lower, food tray and FIG. 5B showing the slide mechanism in the fully opened position with the lower, food tray completely extended FIG. 6 is an explored perspective view of the mechanism employed in the present invention to raise, lower and position the vertical height of the overbed table upper section.

Figure 7:
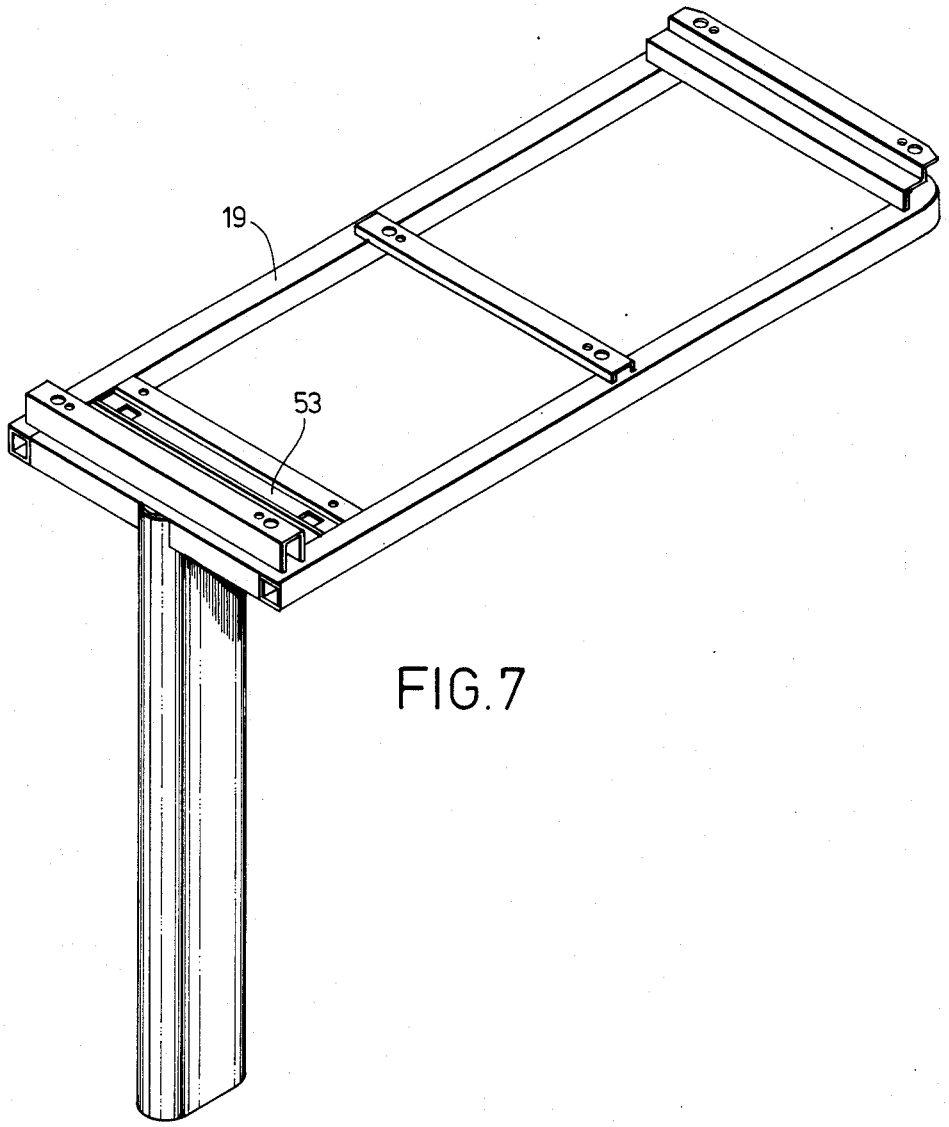

FIG. 7 is a perspective view of the frame employed to support the trays of the overbed table of the present invention.

Figure 8:
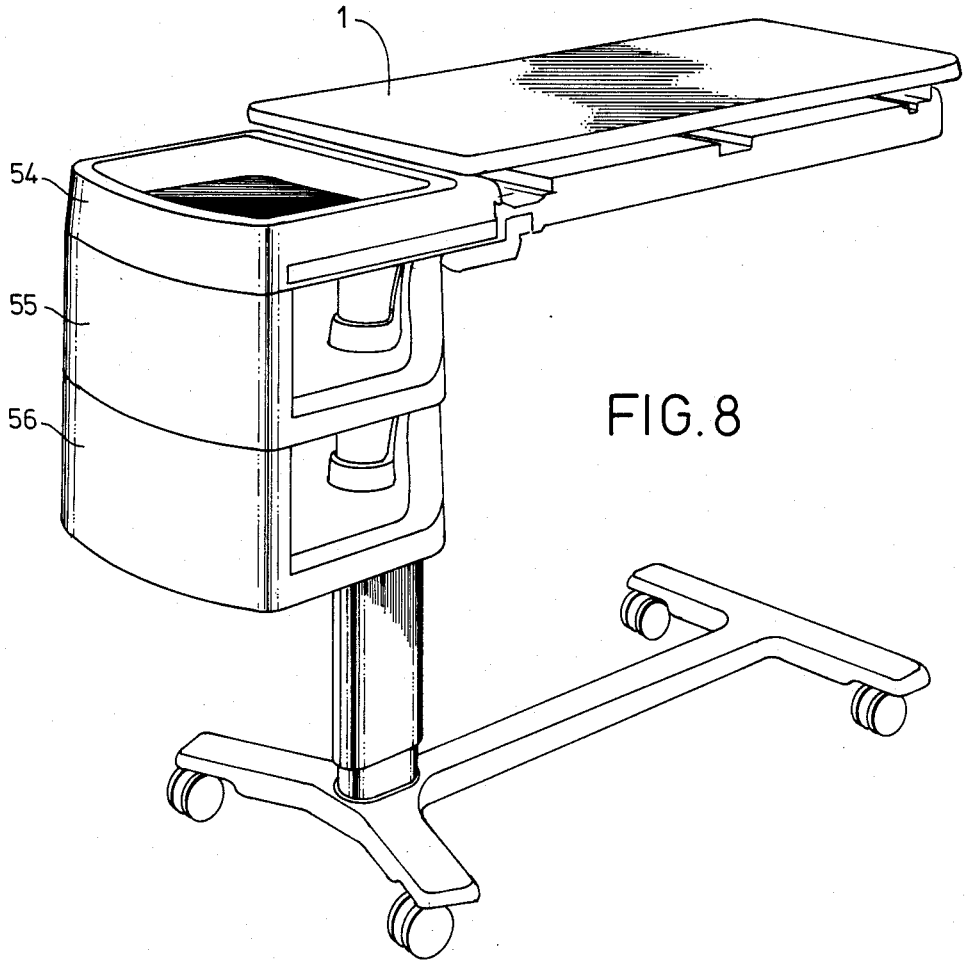

FIG. 8 is a perspective view of the overbed table of the present invention, incorporating storage trays mounted to the vertical section of the table.

DETAILED DESCRIPTION OF PREFERRED EMBODIMENTS OF THE INVENTIONS

In accordance with the present invention, there is provided an improved overbed table for use in hospital rooms or other patient room environments.

The present invention provides two useable horizontal surfaces which may be employed in a variety of different combinations. In general, present invention contemplates a multi-functional table top which can be employed in connection with a base to provide useable horizontal work surface.

By sliding a release lever and pushing away on the upper horizontal surface, a lower horizontal surface is simultaneously exposed and moved in a direction toward the user. This enables the user, with one hand, to expose a clean, uncluttered surface. Release levers are provided on both sides of the table top surface to provide access to the sliding surface mechanism from both sides of the table. In this fashion, the upper surface can be moved away from either side of the table, permitting the lower, unused horizontal tray or surface to be moved toward the user.

That is, the top surface or tray can be slid in either direction by employing the release lever located on either side of the table.

To prevent accidents and provide a stable multi-level combination of horizontal surfaces, the upper surface locks into position when it is moved to the fully open position, e.g., when the lower surface is exposed. Once the table has been opened and the upper surface is locked into position, the table can only be moved back to the closed position by operating the release lever and sliding the top toward the middle of the table. The lower surface automatically retracts to a position directly under the upper surface. To ensure that accidential closings do not occur by pushing on the lower surface, the mechanism is designed to simply not close if the lower surface is pushed forward. The top tray must be pulled toward the user to close the table.

A separate mechanism is provided for sliding the upper and lower trays in unison, without exposing the lower tray, to provide access to storage cavities located in the frame positioned underneath and supporting the tray surfaces. In this fashion, the storage cavities can be hidden by the top and bottom trays until access is desired. By triggering an appropriate release lever and sliding the double-top arrangement in one direction or the other, the storage cavities are exposed. These cavities may be open or may include, e.g., accessories such as mirrors movably mounted therein. When properly positioned, the mirror accessory may also function as a book rest.

Figure 1A:
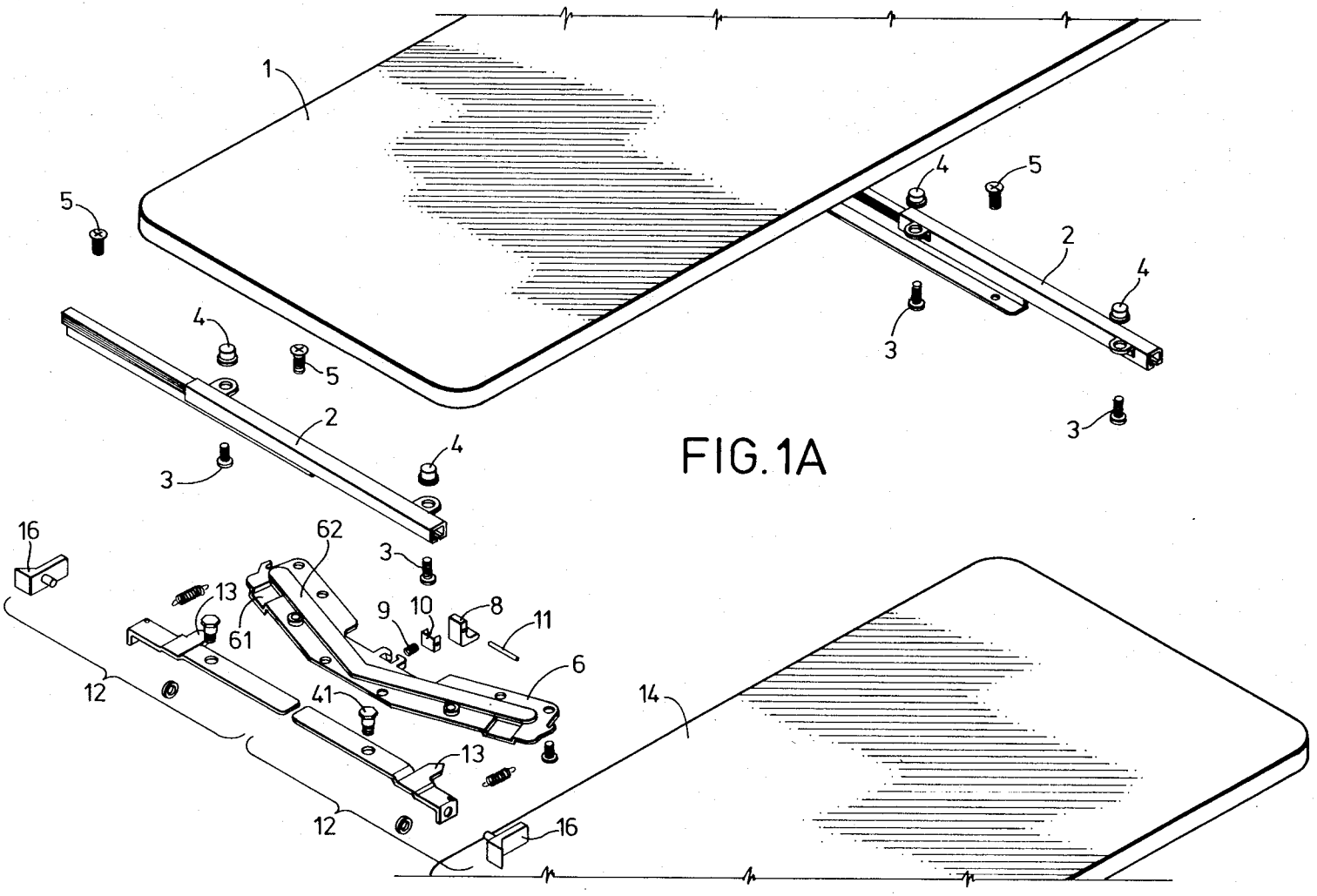
FIG. 1A is an exploded perspective view of a portion of the slide mechanism of the overbed table of the present invention.

Referring to FIG. 1A, top tray 1 secured to a table mounting frame (not shown) by slide pivots 2 mounted in two positions on the underside of the top tray, e.g., at the extreme end portions thereof. Slide pivots 2 are secured to the underside of top tray 1 in a convenient fashion, e.g., by screws 3 or bolts and anchor nuts 4.

The slide pivots are secured to the mounting frame by any convenient means, e.g., by screws 5.

Inboard of one of the slide pivots 2 and mounted to the undersurface of top tray 1 is a cam ramp 6. Cam ramp 6 cooperates with a pivot bar assembly shown in FIG. 1B described below. Cam ramp 6 is secured to the underside of top tray 1. Cam ramp 6 has means to secure the top tray 1 in a fixed position with respect to lower tray 14. As shown in FIG. 1A, center latch 8 is spring loaded and secured to cam ramp 6 in the center thereof. In the preferred embodiment of the present invention, cam ramp 6 is generally horizontal, having a V-shaped portion 62 which is configured to receive a cam ramp bearing mounted on one end of a pivot bar assembly, all shown in FIG. 1B. A spring 9 in a protective cap 10 may also be employed in connection with this center latch mechanism. The center latch is secured by a roll pin 11 to the cam ramp. Left and right release handle and knob assemblies 12 are employed to initiate operation of the present invention. The release assemblies are supported, e.g., in a channel in a support base disclosed herein. Protrusions 13 on release handle assemblies 12 cooperate with cam ramp 6 in grooves 61 formed in cam ramp 6 to permit acutation of the two-way sliding top system.

When the release assembly is triggered by pivoting the same, the center-latch is released from the lower tray, permitting movement of the upper tray in one direction and the lower tray in the opposite direction. When the upper tray has reached its outermost position, thereby exposing substantial portions of the lower tray, the protrusions 13 lock into position, preventing movement of the tray assembly from the fully-opened position. To release the trays from the open position, it is necessary to trigger the release assembly on the side of the table to which the top surface has been opened. This releases the cam ramp bearing (shown in FIG. 1B) which had previously been retained in its outermost position by the protrusion 13 of release lever assemblies 12.

Figure 1B:
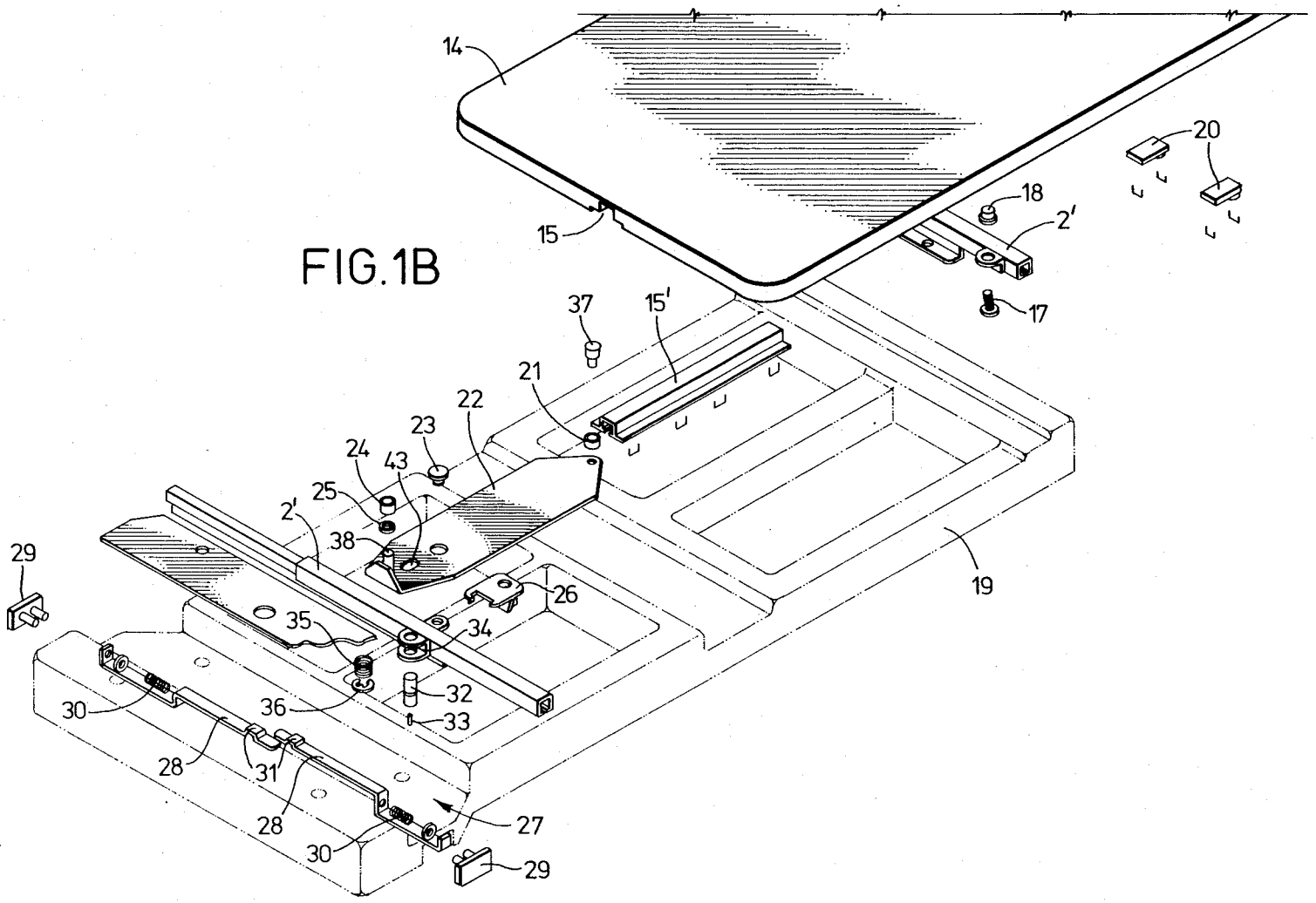
FIG. 1B is an exploded perspective view of another portion of the slide mechanism of the overbed table according to the present invention.

FIG. 1B shows another portion of the mechanism employed in the table surface of the present invention. Lower tray 14 is shown having a slot 15' in the under surface thereof and a bearing guide 15 mounted in the slot. Also attached to the undersurface of lower tray 14 is slide pivot 2', secured by screws or bolt 17 and anchor nuts 18; slide pivots 2' are also secured to lower frame 19.

Disk rollers 20 are also secured to the underside of lower tray 14 to provide ease movement for lower tray 14 when it is slid in one direction or the other.

Bearing guide 15' receives bearing 21, which is rotatably attached to pivot bar assembly 22, pivot bar assembly 22 is secured to lower frame 19 by pivot rivet 23, on the other end of pivot bar assembly 22, cam ramp bearing 24 and washer 25 are attached to pivot bar assembly 22 and cooperate with cam ramp 6 to fit in and move along the-slot 62 formed in cam ramp 6. Pivot rivet 23 is affixed to pivot support bearing 26, mounted on the upper surface of lower frame 19.

The second slide pivot 2' is affixed to the bottom surface of lower tray 14 and the upper surface of lower frame member 19. The slide pivots may be attached by any convenient means, e.g., by screws or bolts and anchor nuts 17 and 18. Slide pivots are mounted on either end of lower tray 14 and the slide pivot mounted on the end nearest the pivot bar assembly is secured in a channel 27 formed in lower frame member 19. On the under surface of channel 27 is mounted a pair of release bars 28. These release bars are secured in channels formed in the undersurface of lower frame member 19 and are operated by release knobs 29 mounted to the exposed ends of release bars 28. Release bars 28 are mounted in a side-by-side fashion, one release bar end knob being exposed on either side of the table surface and frame member. Release bars 28 are spring loaded outward by springs 30. Bars are generally horizontal members with raised surfaces or cams 31 located on the free ends thereof. The free end portions having the cams 31 are parallel to and adjacent each other and the cams 31 are immediately below an opening in channel 27. Immediately above the opening in channel 27 is mounted a locking pin 32. The locking 32 may include a wear insert 33 mounted in the undersurface thereof. The locking pin is secured in place in a bracket 34 mounted on the side surface of a slide pivot 2' nearest the pivot bar assembly by, e.g., compression spring 35 and "C" ring 36.

Figure 2:
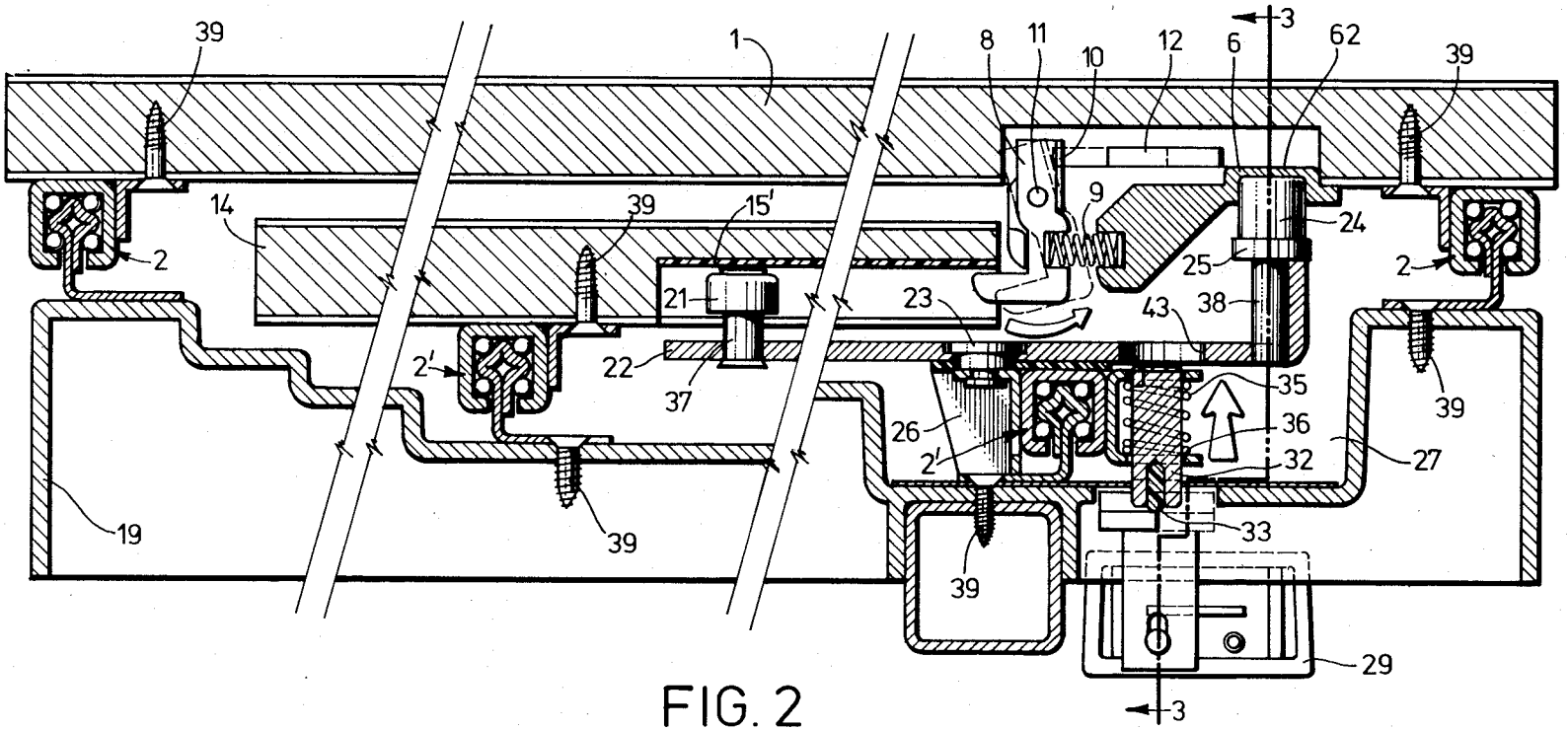
FIG. 2 is a cross sectional view of the upper section of the overbed table of the present invention.

FIG. 2 is a side cross sectional view of the operating sections of the table of the present invention. In this view, roller pivot 37 is shown secured to pivot bar assembly 22 and supporting bearing 21 in bearing guide 15'. Dowel 38 is also shown mounted on one end of pivot bar assembly 22 and supporting washer 25 and cam ramp bearing 24. Cam ramp bearing 24 is shown seated in the track formed in the undersurface of cam ramp 6.

In the embodiment shown in the FIG. 2, screws 39 are shown securing slide pivots 2 to the tray undersurfaces and mounting frame 19. Screws 39 may be used in place of screws or bolts 17 and anchor nuts 18 shown in FIGS. 1A and 1B. Any convenient securing means may be employed to fastening the slide pivots to the table undersurfaces and to mounting frame 19.

Figure 3:
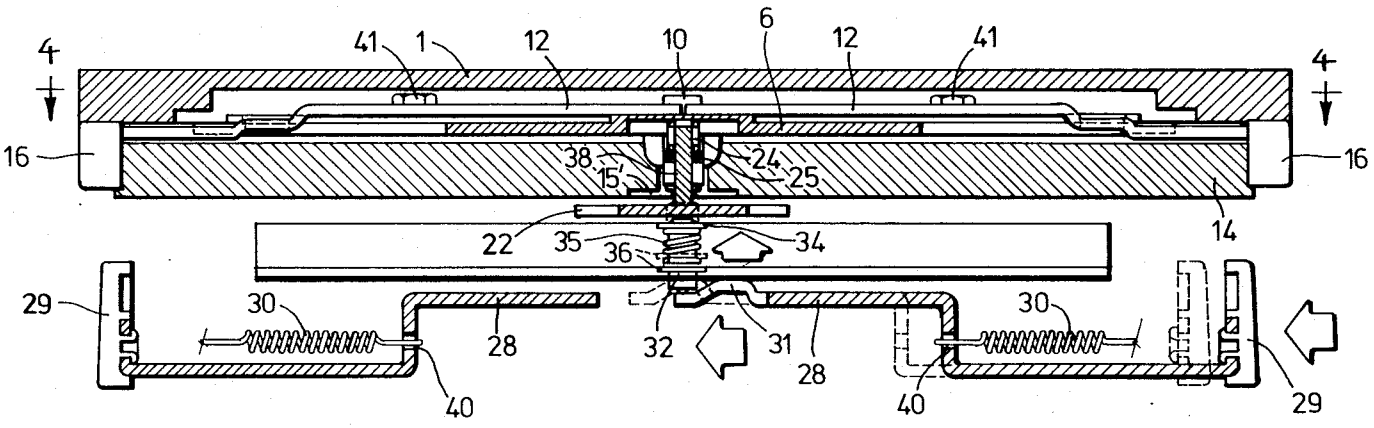
FIG. 3 is a cross sectional view of the upper section of the overbed table shown in FIG. 2, taken along the line 3—3.

FIG. 3 is a cross sectional end view of the table of the present invention, taken along the line 3—3 in FIG. 2. Mounting frame 19 is not shown in FIG. 3. FIG. 3 clearly depicts release bars 28 and their interaction with locking pin 32. The raised or cam portion 31 of release bars 28 forces locking pin 32 upward into the opening 43 of pivot bar assembly 22. This locks pivot bar assembly 22 from any pivoting movement. The camming action between release bar 28 and locking pin 32 occurs when release bar 28 is moved in an inward direction by applying a force to release knob 29. In FIG. 3, the left release bar is shown not having a raised or cam portion 31. This is done for the convenience of clearly displaying the raised portion 31 and the interaction with locking pin 32. In fact, both the left and right release bars 28 have raised or cam portions 31 on the ends thereof for interaction with locking pin 32. Raised portions 31 are parallel to and adjacent each other, as clearly shown in FIG. 1B.

Springs 30 are mounted on release bars 28 to permit the release bars to return to their original position after they are pushed inward to activate locking pin 32 and move it into a locking position with respect to pivot assembly 22. Springs 30 are secured to release bar 28 in openings 40. On the other end, springs 30 are secured in any convenient fashion to the lower frame 19 (securing lower to frame 19 not shown FIG. 3). Release handle assemblies 12 are pivotably mounted with shoulder bolts 41, as shown in FIG. 3.

Figure 4:
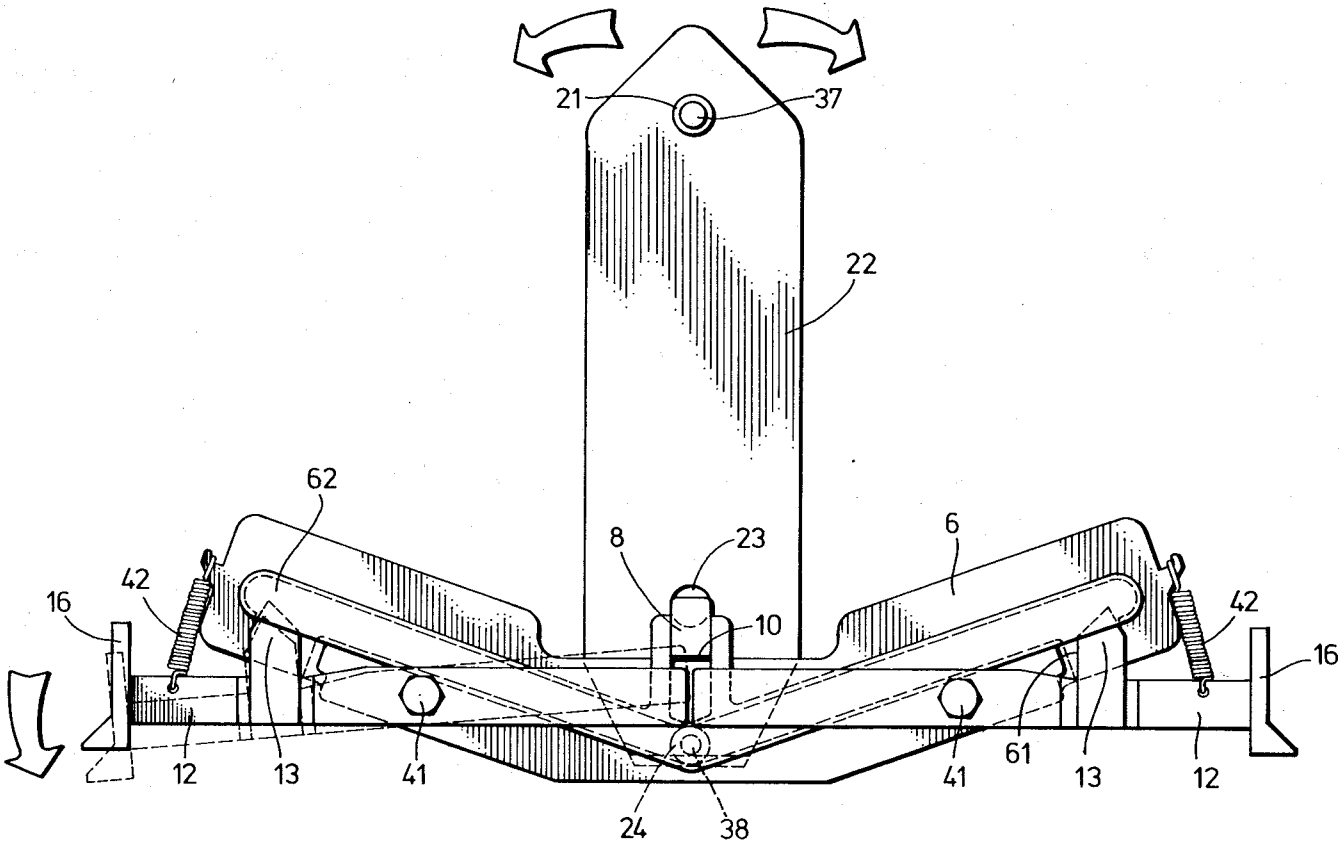
FIG. 4 is a bottom plan view of a slide mechanism of the overbed table top section shown in FIG. 3, taken along the line 4—4.

FIG. 4 shows the interaction between cam ramp 6 and pivot bar assembly 22. Release handle assemblies 12 are attached to springs 42, which are mounted on their other end to a protrusion on cam ramp 6. In this fashion, after release handle assembly 12 is pivoted to release center latch 8 and free up the trays for relative movement, the tension applied to spring 42 by the releasing motion forces release handle assembly 12 back to its original position.

FIGS. 5A and 5B show the action which occurs when the upper and lower table trays are moved relative to each other. The double tray is activiated by sliding release knob 16 and thereby pivoting release handle assembly 12. The pivoting motion of release handle assembly 12 unlocks center latch 8 from a notch or slot in the lower tray, freeing up the two tops for relative movement. When force is applied to the top tray, pivot bar assembly 22 is forced to rotate. At the same time, the lower tray is forced to move in the opposite direction. A mechanical advantage is obtained by applying force to the top tray as opposed to the bottom tray. When the bearing 24 has moved to the end of one of the legs of the V-shaped channel 62 in cam ramp 6, the bearing passes protrusion 13 on release handle assembly 12 and is held in position at that point by protrusion 13. This secures the position of trays 1 and 14 and locks them in place.

To move the trays back into the original or stacked position, where tray 1 is directly over tray 14, release handle assembly 12 must be activiated by pushing release knob 16. The appropriate release handle to activate is the one located at the center of the table, immediately adjacent to the bearing which is now locked in position by protrusion 13. When the two trays reach the original or center position, the center latch 8 moves back into the slot or notch, securing the trays in a position where tray 1 is directly over tray 14.

During this operation, trays 1 and 14 move with respect to each other along slide pivots 2. Pivot bar assembly 22 has one bearing mounted in bearing guide 15' and another bearing mounted in cam ramp 6. Cam ramp 6 is symmetrically designed to permit movement of the top tray in either direction. Bearing 21 moving in bearing guide 15' is also capable of moving in either direction. Regardless of which direction is selected, bearing 21 moves along the length of bearing guide 15', forcing the movement of lower tray 14 in a direction opposite to the movement of top tray 1.

It is also possible to operate the tray of the present invention to move the upper and lower trays 1 and 14 in unison in either direction along slide pivots 2. This is desirable to expose cavities in lower frame 19. These cavities permit storage of supplies or personal items or, e.g., mounting of a accessories such as mirror which may be moved into a position for viewing once the trays have been moved out of the way to expose the cavity and mirror. The mirror may be employed, e.g., for other purposes, such as for a support for a book or other reading material.

In operation, release bars 28 are positioned on either side of the table/frame assembly and are operated by release knobs 29 along the edge of frame 19. By pushing one of the release knobs inward, the raised or cammed portion 31 of release bar 28 comes into contact with locking pin 32 and moves it in an upward direction into a hole or aperture in pivot bar assembly 43. At the same time, locking pin 32, which in its original or seated position, precludes the lateral movement of the slide pivot 2 having the bracket 34 attached thereto. When locking pin 32 is raised by release bar 28, slide pivot 2 is free to move laterally and this allows the trays 1 and 14 to move in unison, with locking pin 32 moving in unison with slide pivot 2 and remaining contained in bracket 34. When the release bar is triggered, trays 1 and 14 cannot move relative to each other because locking pin 32 inserted into aperture 43 in pivot bar assembly 22 precludes relative movement of the trays 1 and 14.

In the same fashion, when the trays 1 and 14 are being moved relative to each other by employing pivot bar assembly 22, the release mechanism for operating both trays in unison is not available for use. The bottom surface of pivot bar assembly 22 touches the top of locking pin 32 and precludes it from moving upward. Only when the pivot bar assembly 22 is returned to its original position with trays 1 and 14 directly above and below each other is aperture 43 in a position to receive locking pin 32. In this fashion, users are precluded from mistakingly employing both release mechanisms at the same time.

FIG. 6 shows a lift mechanism for permitting upward and downward vertical movement of the table assembly of the present invention. The lift mechanism composes a gas spring 57 and a locking mechanism 44. The locking mechanism is attached to rod 45 protruding from gas spring 57. The locking mechanism comprises a cylinder cam 46, a rod lock 47, a "U"-shaped bracket 48, a release bracket 49, a compression spring 50 and a release rod 51. The locking mechanism 44 is secured to the piston rod 45, e.g., by set screws 52.

The locking mechanism's uni-directional locking function only operates when the table is moved in a downward direction. Rod lock 47 has an eccentric countersink. In its normal, at-rest position, the rod lock is pushed off center by the eccentric countersink, causing a binding of the piston rod 45 and resulting in a locking action. In order to release the lock mechanism 44, release rod 51 must be pulled in an upward direction, which in turn acctuates release bracket 49 which is caused to pivot about the center of "U"-shaped bracket 48. Release bracket 49 comes into contact with a flange on rod lock 47 and forces rod lock 47 away from the cylinder cam 46. When the rod lock is placed in this position, the piston is free to move in either direction.

As noted above, the rod lock mechanism 44 is unidirectional and movement of the table in an upward direction is always permitted by the configuration discussed above without the release of release rod 51. When the table is moved upward to the desired position, the weight of the table surface is greater than the upward force applied by the gas spring 57 and the table will therefore stay in the selected position. Downward movement from the selected position is precluded by lock mechanism 44, until release rod 51 and release bracket 49 are activated. Any convenient gas spring may be employed in the present invention. A preferred gas spring is Suspa model manufactured by Suspa, Grand Rapids, Mich.

FIG. 7 shows one embodiment of a mounting frame 19 which may be employed in the present invention to support table trays 1 and 14. In FIG. 7, channel 53 is configured to receive release bars 28.

FIG. 8 shows an overbed table in accordance with the present invention which includes storage compartments 54, 55 and 56. Upper storage compartment 54 has a recessed top area for receiving and retaining any variety of items. Lower storage trays 55 and 56, which may be of any convenient configuration, are rotatably mounted on the vertical section of the overbed table and can be pivoted to one side or the other to expose a recessed storage area.

Employing storage facilities such as those described above mounted directly to an overbed table eliminates the need for a bed-side cabinet and brings the patient's belongings to a location where they are more readily accessable to the patient. This can aid in hospital safety by allowing the patient to access his or her belongings without leaving the bed and subjecting himself or herself to possible bed falls.

Although the present invention has been described in connection with the preferred embodiments thereof, it will be appreciated by those skilled in the art that additions, modifications, substitutions and deletions not specifically described may be made without departing from the spirt and scope of the invention as defined in the appended claims.

What is claimed is:

1. An improved table providing two usable horizontal surfaces, comprising:

(a) an upper horizontal table surface;

(b) a lower horizontal table surface positioned generally under said upper horizontal table surface, so that the lower horizontal table surface is not usable; said upper and lower table surfaces being mounted on slide members;

(c) means for concurrently moving said upper and lower horizontal table surfaces in opposite directions to expose the lower horizontal table surface and to render said lower horizontal table surface available for use such that said upper table surface may be moved in either one of two directions relative to said lower table surface and movement of said upper table surface in one of said directions will cause movement of said lower table surface in the other of said two directions, said means for concurrently moving said table surfaces comprising a pivot means operably connected to the upper and lower table surfaces, said pivot means comprising an elongate pivot bar assembly having bearing means mounted on each end thereof and confirgured to cooperate with a generally V-shaped channel in the undersurface of said upper table surface and a generally elongate channel formed in the underside of said lower table surface and extending generally transverse to the direction of movement of said lower table surface, wherein movement of said upper table surface in one direction automatically results in movement of said lower table surface in the opposite direction; and (d) latch means positioned to hold said table surfaces in a position where the upper surface is directly over the lower surface and means for releasing said latch means to permit said table surface to be concurrently moved in opposite directions.

2. The improved table according to claim 1 wherein said means for releasing said latch means comprises a pair of elongate pivotedly mounted arms, each of said arm further comprising a protrusion configured to interact with said V-shaped channel to lock said bearing means in position in said channel when said bearing means reaches an end of said channel.

3. The improved table according to claim 2 wherein said V-shaped channel is a preformed structure mounted to the undersurface of the top horizontal surface.

4. The improved table according to claim 1 which further includes:

means, operably connected to said pivot means, to lock said upper and lower table surfaces together in overlapping relationship, whereby movement of said upper table surface in one direction will automatically result in the movement of said lower table surface in the same direction in overlapping relationship with said upper table surface.

* * * * *